United States Patent [19]

Pfeilsticker et al.

[11] 3,986,294

[45] Oct. 19, 1976

[54] MINIATURE TOY FORK LIFT VEHICLE

[75] Inventors: Lee J. Pfeilsticker, Long Lake; Vernon R. Wamsley, Wayzata; Thomas W. Good, Minnetonka, all of Minn.

[73] Assignee: Tonka Corporation, Hopkins, Minn.

[22] Filed: Jan. 15, 1975

[21] Appl. No.: 541,226

[52] U.S. Cl. ..... 46/40

[51] Int. Cl.[2] ..... A63H 33/30

[58] Field of Search ..... 46/40, 39, 202; 187/24, 187/25, 26; 214/95 R

[56] References Cited

UNITED STATES PATENTS

| | | | |
|---|---|---|---|
| 1,101,598 | 6/1914 | Weinke | 187/24 |
| 1,228,162 | 5/1917 | Anderson | 187/24 X |
| 1,901,726 | 3/1933 | Bonnet | 187/24 X |
| 2,529,749 | 11/1950 | Wade et al. | 46/40 X |
| 2,601,930 | 7/1952 | Druge et al. | 46/40 X |
| 2,895,567 | 7/1959 | Hall | 187/24 X |

FOREIGN PATENTS OR APPLICATIONS

| | | | |
|---|---|---|---|
| 939,437 | 2/1956 | Germany | 46/40 |
| 939,976 | 3/1956 | Germany | 46/40 |

*Primary Examiner*—F. Barry Shay

*Attorney, Agent, or Firm*—Douglas L. Carlsen

[57] ABSTRACT

A miniature toy fork lift vehicle having a body supported on ground wheels, an upright frame mounted on the front portion of the body and having a pair of upright parallel guide rails spaced transversely of the vehicle, a lift fork including a carrier mounted on the guide rails for vertical sliding movement, an upright screw member disposed between the guide rails and journaled in the upright frame and having a threaded portion in threaded engagement with the carrier to raise and lower the lift fork as the screw is turned. The guide rails form a roll cage over an operator's station. The lift fork may be pivoted to an inactive position to reduce the vehicle length for packaging or storage.

2 Claims, 4 Drawing Figures

MINIATURE TOY FORK LIFT VEHICLE

This invention relates generally to miniature toy vehicles of the type generally played with by children in the very young age group and more particularly concerns such a vehicle which has a front lift fork and a manually operated mechanism for raising and lowering the fork.

While miniature toy vehicles of virtually all types have been produced to simulate their full sized counterparts, the production of a satisfactory fork lift truck has not been accomplished due to the lack of development of an operative fork raising and lowering mechanism that is both inexpensive and durable.

Accordingly the object of the present invention is to provide a miniature toy fork lift vehicle with a relatively simply constructed vertical sliding arrangement of the fork lift on the vehicle body as well as an inexpensive but durable mechanism for actuating said vertical sliding movement of the fork lift.

With this and other objects in view the invention broadly comprises providing a miniature toy vehicle with a fork lift mounted on a pair of upright rods or rails on the vehicle body for vertical sliding movement of the fork lift with a rotatable elevating screw journaled and axially fixed on the body and between the rails and having a threaded engagement with the fork lift to move the fork lift as it is rotated, and a manual control at the upper end of the screw for selectively rotating the screw to raise or lower the fork lift.

Brief Description of the Drawings

In the drawings:

FIG. 1 is a side elevation of a miniature toy lift truck vehicle embodying the present invention and showing the lift fork in partially raised condition.

Description of the Preferred Embodiment

Figure 2:
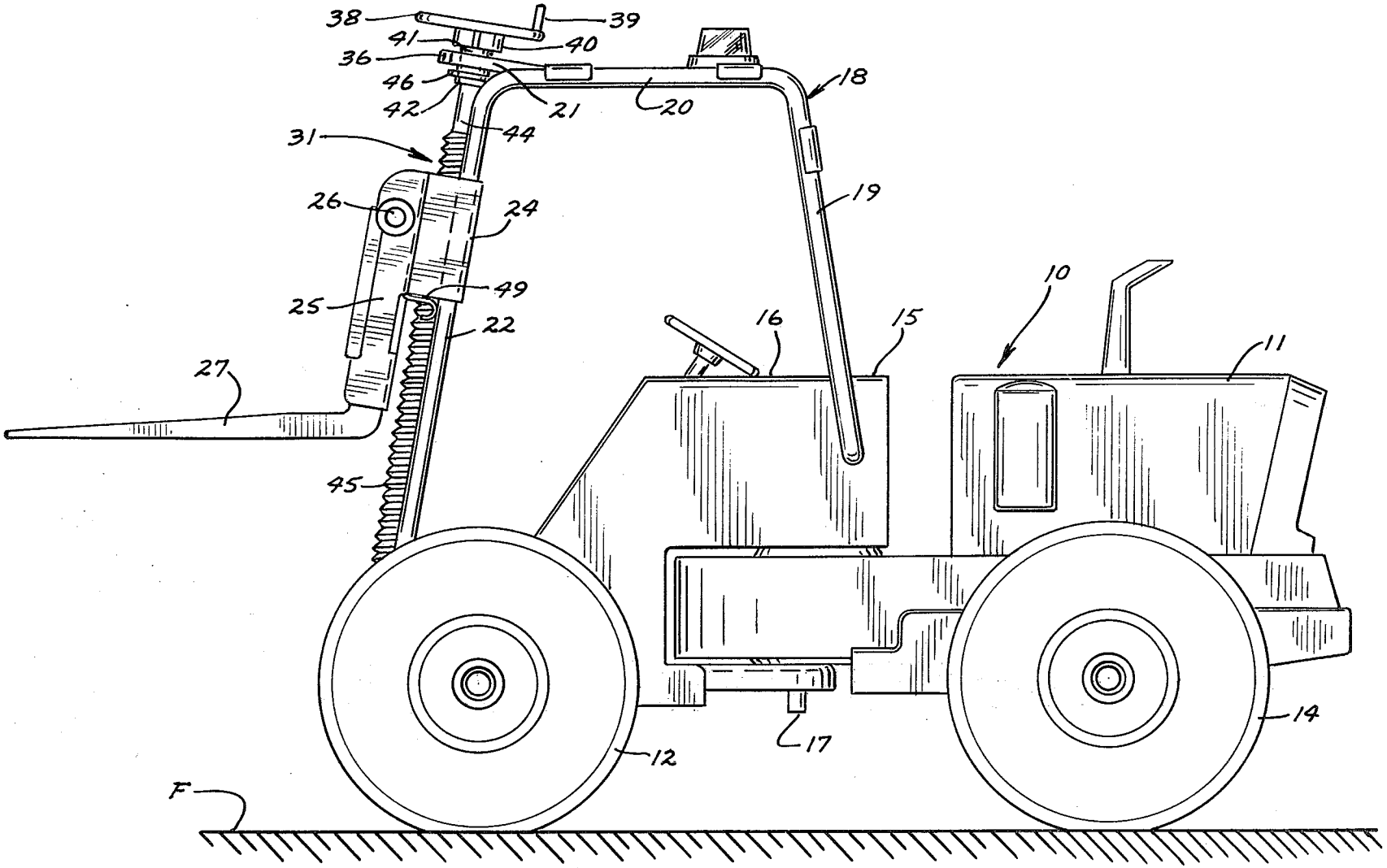
FIG. 2 is a front elevation of the truck in the same condition as shown in FIG. 1.
Figure 2:
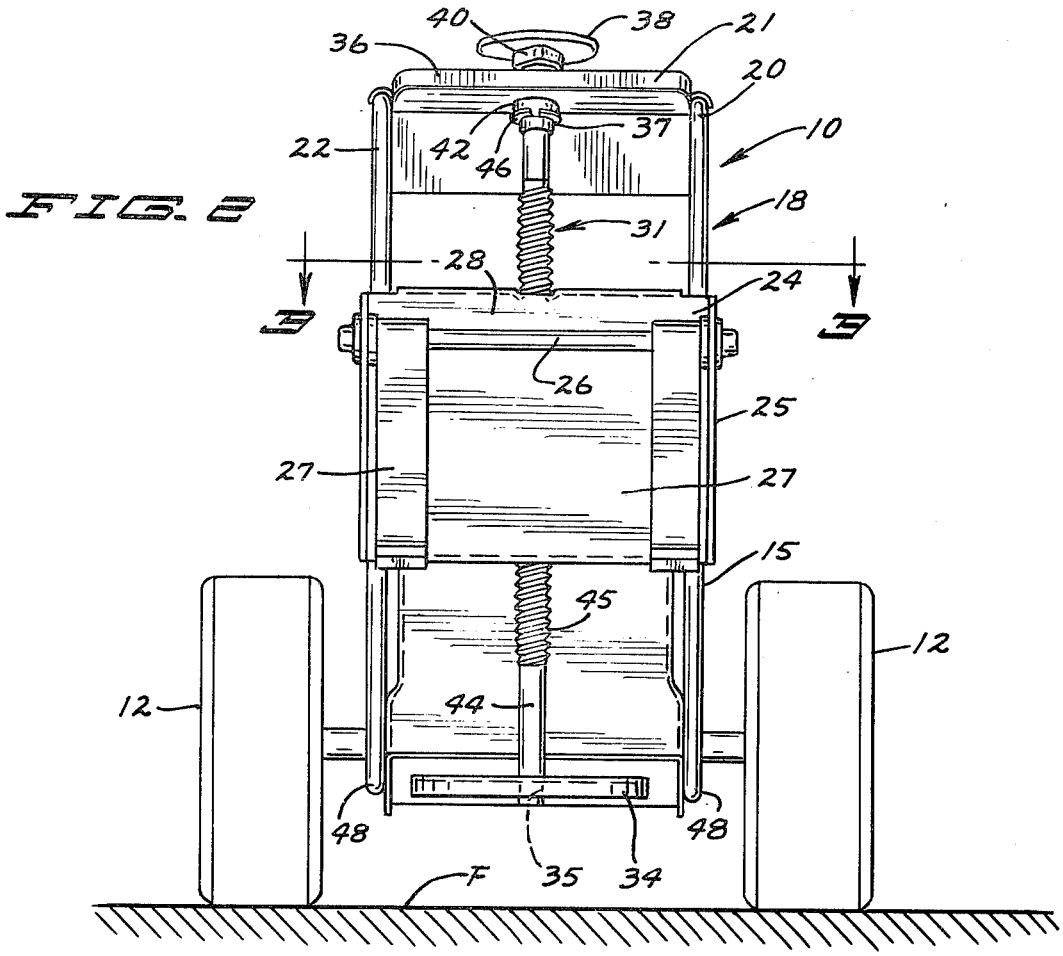

Referring now more particularly to the drawings reference numerals will be used to denote like parts or structural features in the different views. The miniature toy fork lift vehicle is denoted generally by the numeral 10 and includes a base vehicle 11 supported on a rear set of ground wheels 14 and a front vehicle section 15, which may be referred to as a swivel cab as it contains the operator's station at 16, and is supported on a set of front ground wheels 12. The vehicle section 15 is connected to the base vehicle 11 by a vertical pivot pin 17 so that the two sections are capable of articulatory movement about the pin axis.

The vehicle section 15 has a roll cage denoted generally at 18 mounted thereon. This comprises a pair of rods 19 which are bent in an inverted U-shape and which are mounted to lie on substantially parallel fore and aft planes with their ends attached to the vehicle section 15. The bight portions 20 of the rods 19 are interconnected by a roof panel 21. The front portions of rods 19 form guide rails 22 which are vertical and incline slightly rearwardly in parallel positions in their upward extension. A carrier frame or fork support bracket denoted generally at 24 is mounted for generally vertical sliding movement along the guide rails 22.

Figure 3:
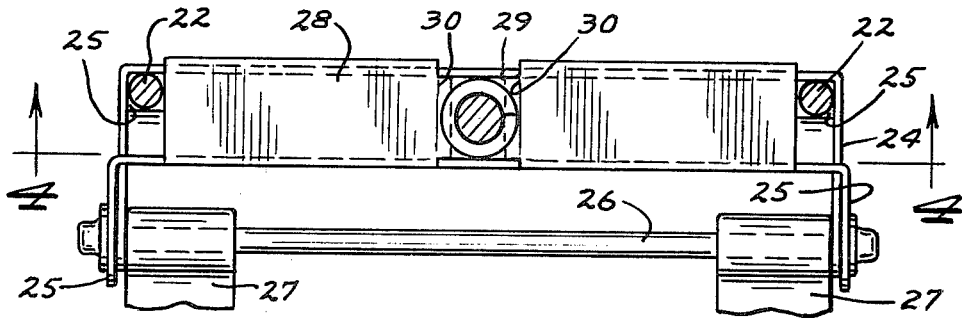
FIG. 3 is a horizontal section through the front portion of the protective cage on the truck taken on line 3—3 of FIG. 2.

The carrier frame 24 has vertically opening passageways 25 (FIG. 3) near its ends for slidably receiving the guide bars 22. Frame 24 also has forwardly extending transversely spaced flanges 25 which jointly support a horizontal fork pivot pin 26 upon which a pair of L-shaped forks 27 are journaled.

Figure 4:
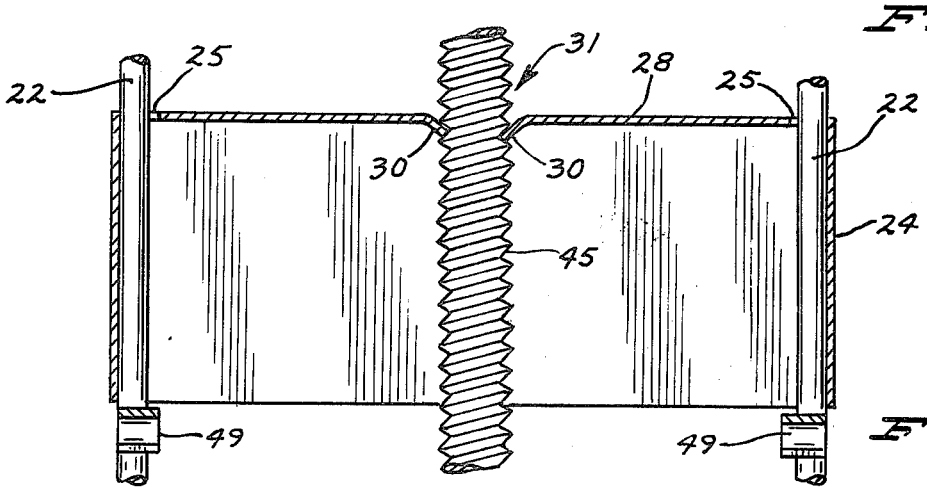
FIG. 4 is a transverse vertical section taken on line 4—4 of FIG. 3.

The frame 24 also has a top plate 28 which has an opening 29 (FIGS. 3 and 4) centered transversely therein. The opposing side edges of opening 29 are bent slightly downward as at 30 and form a socket for screw threaded reception of a rotatable elevating screw denoted generally at 31. A horizontal ledge 34 extends forwardly from the front lower portion of vehicle section 15 between wheels 12 and has a vertically opening round aperture 35 centered transversely therein. Similarly, the roof panel 21 has a forwardly extending visor portion 36 which is provided with a vertically opening round aperture 37 centered transversely therein. Both of the apertures 37 and 35 lie on the longitudinal vertical center plane of the vehicle section 15.

The elevating screw is preferably molded of plastic material as an integral unit. At its upper end the screw has a disk-shaped head 38 with an upwardly projecting handle 39 offset from the center of the head. Below the head 38 the screw has a bearing neck with a portion 40 which is greater in diameter than aperture 37 and a portion 41 of a diameter slightly smaller than the aperture. A groove collar 42 is provided in the screw just below bearing portion 41. The screw below collar 42 is a simulated elongated shaft 44 having the major central portion of its length provided with a spiral screw thread 45 adapted for threaded engagement with the edges 30 of the opening 29 in plate 28.

In assembly, after the frame 24 has been mounted on guide rails 22 the elevating screw 31 is inserted downwardly through the aperture 37 and opening 29 until the lower end of shaft 44 seats in the aperture 35 with the lower end of the screw thread 45 resting upon the plate 28. As screw 31 is then turned the threaded portion will engage the edges 30 and the screw will move downwardly until portion 40 engages the visor 36 and the collar 42 is disposed below the visor. A snap ring 46 of greater diameter than the aperture 37 is then snapped into the groove of collar 42, preventing upward removal of screw 31.

It will now be understood that by manually controlling handle 39 to rotate the screw 31 the carrier frame 24 and the forks 27 carried thereby may be selectively raised or lowered between a maximum height position slightly higher than that shown in FIG. 1 and a completely lowered position wherein the forks 27 engage the floor surface F.

When the carrier reaches its maximum height position it will ride off of the upper end of thread 45 so that continued rotation will not damage the screw. The top flight of the thread 45 will automatically reengage edges 30 when rotation is reversed. The length of shaft 44 above threaded portion 45 is sufficient to prevent finger entrapment between the carrier frame top plate 28 and visor 36.

The lower ends of the guide rails 22 curve slightly rearwardly at 48 (FIG. 2) prior to connection with vehicle section 15. Each flange 25 on the carrier frame 24 supports a rearwardly extending projection 49 (FIG. 1) which slides along the front surface of the adjacent guide rail 22 during the raising and lowering movement. This sliding contact retains the frame 24 and the forks 27 on a fixed path. However, when the forks approach their completely lowered positions the projections 49 will move slightly rearwardly along the curved portions 48 of rails 22 allowing the carrier frame 24 and forks 27 to tilt slightly forward so that the forks 27 engage the floor F at a slight angle rather than flush to facilitate load pick up by the forks.

The hinge pin 26 mounting of the forks 27 permits the forks to be swung upwardly approximately 180 degrees to positions along the bight portions 20 to reduce the overall length of the vehicle for packaging or storage. It is found that while journaling the lower end of the elevating screw in a socket such as at 35 is desirable in larger models, it is not absolutely essential.

Having now therefore fully illustrated and described our invention, what we claim to be new and desire to protect by Letters Patent is:

1. In a miniature toy fork lift vehicle having a body and ground wheels or the like for traverse of the vehicle in fore and aft directions over a floor surface, the vehicle having an operator's station in the front portion thereof, a. a pair of rods bent in an invertd U-shape mounted to lie on transversely spaced fore and aft planes one on each side of the operator's station with their ends attached to the vehicle body, b. a cross member integrally connecting the bight portions of the rods and jointly with said rods forming a roll cage over the operator's station with the front portionsof said rods forming a pair of upright parallel guide rails, c. a carrier frame mounted on the guide rails for vertical sliding movement therealong and carrying a lift fork, d. an upright rotatable elevating screw centered transversely between the guide rails having its upper end journaled in the cross member and a threaded portion in screw threaded engagement with the carrier frame to raise or lower the frame along the rails as the screw is rotated, and e. handle means on the upper end of the screw for manual rotation thereof.

2. In a miniature toy fork lift vehicle having a body and ground wheels or the like for traverse of the vehicle in fore and aft directions over a floor surface, a. a pair of upright parallel guide rails mounted on the forward end of the body and spaced apart transversely relative to the direction of travel of said vehicle, b. a carrier frame mounted on the guide rails for vertical sliding movement therealong and carrying a lift fork, c. a cross member rigidly connecting the upper ends of the guide rails, d. an upright rotatable elevating screw centered transversely between the guide rails having its upper end journaled in the cross member and a threaded portion in screw threaded engagement with the carrier frame to raise or lower the frame along the rails as the screw is rotated, e. handle means on the upper end of the screw for manual rotation thereof, and f. said vehicle including means for reducing the overall length of the vehicle in that said lift fork comprises L-shaped members each normally extending downwardly and forwardly from a pivot axis with its upper end pivotally connected on a transverse axis to the carrier frame for swinging movement of the fork upwardly approximately 180° to a position where it extends upwardly and rearwardly from the pivot axis.

* * * * *